US006830166B1

(12) United States Patent
Laats et al.

(10) Patent No.: US 6,830,166 B1
(45) Date of Patent: Dec. 14, 2004

(54) STRAP RETENTION SYSTEM AND USES THEREFOR

(75) Inventors: Andy Laats, Cardiff, CA (US); Kirk James, Portland, OR (US)

(73) Assignee: Nixon, Inc., Encinitas, CA (US)

( * ) Notice: Subject to any disclaimer, the term of this patent is extended or adjusted under 35 U.S.C. 154(b) by 509 days.

(21) Appl. No.: 09/608,985

(22) Filed: Jun. 30, 2000

(51) Int. Cl.[7] ..... A44C 5/00
(52) U.S. Cl. ..... 224/164; 24/182; 24/183
(58) Field of Search ..... 224/164; 24/182, 24/183; 2/338

(56) References Cited

U.S. PATENT DOCUMENTS

| | | | | | |
|---|---|---|---|---|---|
| 135,744 | A | * | 2/1873 | Adams | |
| 159,009 | A | * | 1/1875 | Wiswell | |
| 310,719 | A | * | 1/1885 | Parmerlee et al. | 24/265 AL |
| 374,177 | A | * | 12/1887 | Detrick | 24/265 R |
| 410,260 | A | * | 9/1889 | Bagley | |
| 619,540 | A | * | 2/1899 | Burson | |
| 970,184 | A | * | 9/1910 | Conway | |
| 1,100,389 | A | * | 6/1914 | Miller | |
| 1,414,048 | A | * | 4/1922 | Schlutz | |
| 1,958,911 | A | * | 5/1934 | Christoffersen | 24/265 AL |
| 3,378,181 | A | * | 4/1968 | Hirsch | 224/178 |
| 4,054,952 | A | * | 10/1977 | Swallow | 2/338 |
| 4,664,533 | A | * | 5/1987 | Wollman | 224/164 X |
| 5,251,361 | A | * | 10/1993 | Owens et al. | 24/182 |
| 5,367,714 | A | * | 11/1994 | Hines et al. | |
| 5,452,498 | A | * | 9/1995 | Veach | 24/176 |
| 5,860,198 | A | * | 1/1999 | Buntin, Jr. | 24/600.5 |
| 6,351,874 | B1 | * | 3/2002 | Suggs | 24/265 BC |

FOREIGN PATENT DOCUMENTS

| | | | | |
|---|---|---|---|---|
| DE | 521751 | * | 3/1931 | 224/164 |

* cited by examiner

*Primary Examiner*—Stephen K. Cronin
(74) *Attorney, Agent, or Firm*—Pillsbury Winthrop LLP

(57) ABSTRACT

In accordance with the present invention, there are provided fastening systems for straps. Invention fastening systems provide for the secure fastening of straps which employ a securing device such as a buckle, by providing anchor points to retain strap ends. In this manner, free-hanging strap ends are prevented, thus providing a secure, hassle-free system for retaining devices such as wristwatches, and the like.

12 Claims, 2 Drawing Sheets

STRAP RETENTION SYSTEM AND USES THEREFOR

FIELD OF THE INVENTION

The present invention relates to fastening devices. In particular aspect, the present invention relates to a strap retention system ideally suited for watchbands and the like.

BACKGROUND OF THE INVENTION

The wristwatch is a commonly worn article. Other wrist-born devices such as tide timers (e.g., the Nixon SUPER HERO™), altimeters, pressure gauges, pedometers, and the like are becoming increasingly popular as well. Many of these devices make use of a strap having two free ends (as opposed to, for example, a metal bracelet with a flip catch) that are secure to one another, usually by means of an adjustable mechanism such as a buckle or similar securing mechanism.

One dilemma posed by the two piece strap with adjustable securing mechanism is what to do with the free end of the strap, once the strap has been adjusted to the desired size. If simply left to hang, the free end of the strap can work loose of the buckle thereby releasing the strap. Minimally, the free end is prone to get in the way if it is not secured in some manner. This problem is frequently dealt with by including retention loops near the buckle, for receiving the free end of the strap and maintaining it in close proximity to the other end of the strap (e.g., the end that has the buckle). Unfortunately, the retention loops can slide free of the strap end which is again left to hang loose. Securing the retention loops to the portion of the strap that is not hanging free prevents them from moving, but also limits the adjustability of the strap because the loops may not function properly over the full range of the strap's adjustability.

Any type of strap that is to be secured, for whatever purpose, may also suffer from the same problems described above. Examples, such as straps to secure luggage on a car roof, or the like, provide familiar instances where such problems may be encountered.

Accordingly, there is still a need in the art for a means to further securely retain the free end of a two-ended strap that is used in conjunction with a securing mechanism.

BRIEF DESCRIPTION OF THE INVENTION

The present invention overcomes many of the problems in the art by providing a retention system for straps. Invention retention systems provide structures that are easily incorporated into straps and which prevent inadvertent loosening of the strap, as well as maintaining the otherwise free end of a fastened strap in close proximity with the remainder of the strap. This latter property of the invention system provides a safety feature by preventing loose strap ends from interfering with strap use.

DETAILED DESCRIPTION OF THE INVENTION

Figures 1, 2, 3, 4, 5, 6, 7, 8:
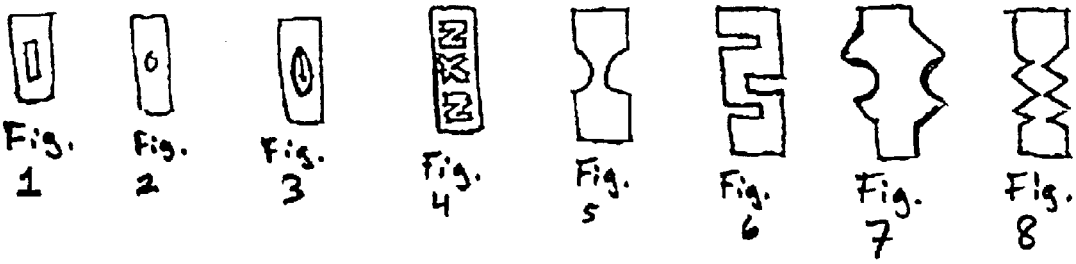
FIGS. 1–8 depict different geometric shapes useful as retention loop components of mating structures.
Figure 9:
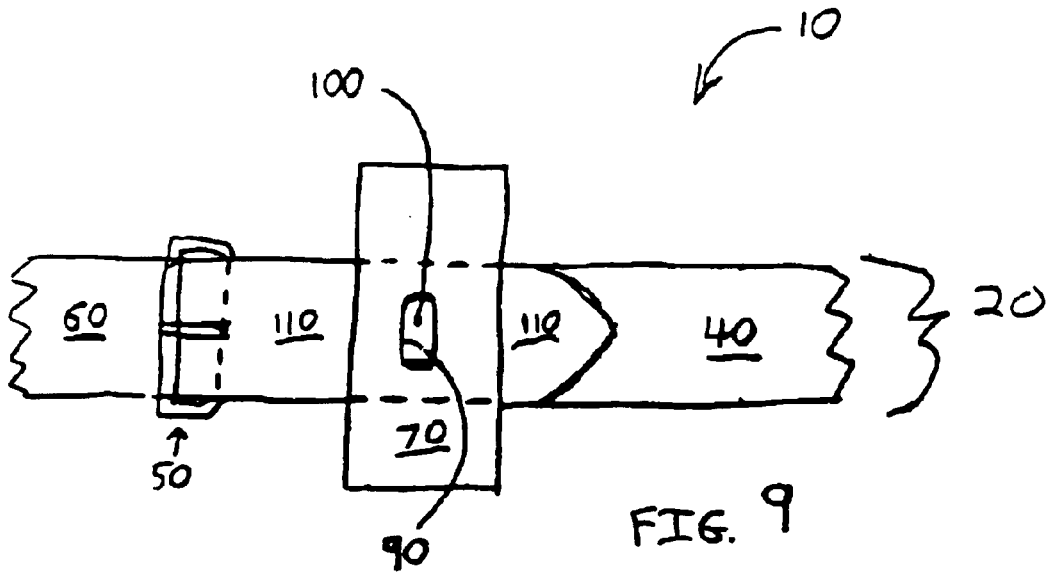
FIG. 9 depicts a front perspective view of a strap retention system according to an embodiment of the present invention.
Figure 10:
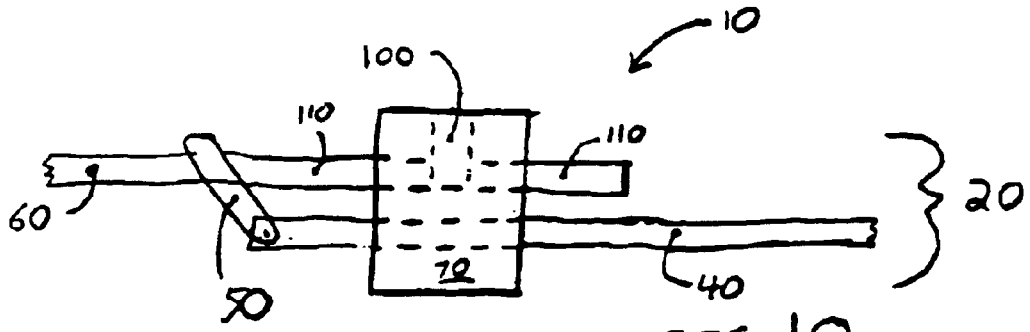
FIG. 10 depicts a side perspective view of the strap retention system of FIG. 9.

In accordance with the present invention, there is provided a fastening and retention system 10 for a strap 20, said system comprising a strap 20 having at a first strap end 40, a securing mechanism 50 configured to receive a second strap end 60, and one or more retention loops 70 for maintaining, when said second strap end 60 has been secured by said securing mechanism 50, said second strap end 60 in close contact with a portion of the strap that is proximal to the first strap end 40, wherein said retention loop(s) 70 can slide along said strap 20 when the strap 20 is not secured by said securing mechanism 50, wherein one or more of said retention loops 70 comprises a first component of a mating structure 90, and said strap comprises a complementary component of the mating structure 100, and wherein said mating structure 90,100 prevents said loop(s) 70 from sliding freely along said strap 20 when the two components 90,100 are mated.

Any type of strap 20 is suitable for use in the practice of the present invention, so long as it has a securing mechanism 50 for mating opposing strap ends 40,60. As used herein, "securing mechanism 50" means any type of structure that is useful for securing one end 40 of a strap 20 to a second end 60. Typically, such securing devices 50 provide for adjustment of the strap length in order to modulate the tightness of the strap 20 around the item to which it is secured. Thus, for example, a typical watchband 20 has a buckle 50 which allows for the strap 20 to be cinched to a desired tightness. As a result of securing the strap 20, there will typically be excess strap 110 at one end that would benefit from being retained to prevent inadvertent loosening, and/or to prevent the loose end of the strap from getting in the way. Any securing device 50 that, when employed, results in a loose strap end 110 can be employed in the practice of the present invention. Such structures include conventional prong-type buckles, FASTEX™ type buckles, cams, and the like.

The strap 20 may be comprised of any suitable material for the intended application, including, for example, fabric, leather, metal (optionally with links, as required for flexibility), polymer (e.g., polyurethane, polyurethane/silicon blend, nylon, polyvinyl chloride (PVC), or the like), leather, and the like.

Figure 11:
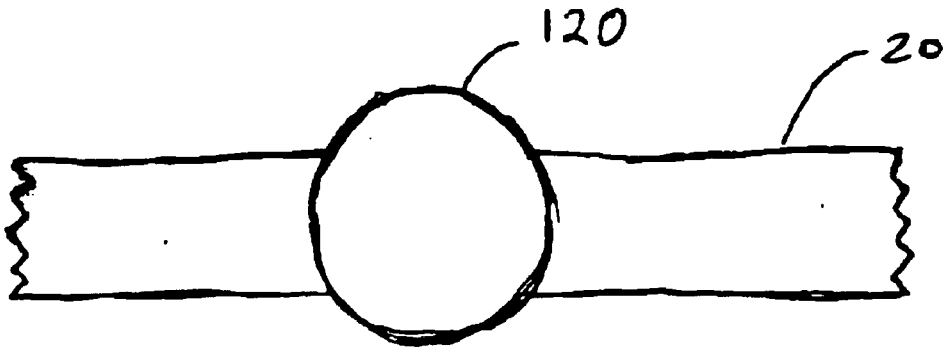
FIG. 11 depicts a front perspective view of a device fastened to the strap retention system of FIG. 9.

In one embodiment, the strap is configured to receive thereon a device 120 (see FIG. 11). For example, a plain strap can have attachment points, such as loops, or the like, for fastening a device 120 to the strap. In another embodiment, the strap is a two piece strap 20, such as a watchband 20, that, upon attachment of the two pieces to a device 120, such as a watch, essentially becomes a single strap 20 having two ends 40,60. Devices that are typically mounted on a strap include a wristwatch, an altimeter, a depth meter, a pedometer, a pager, a telephone, a personal data device, a tide meter, and the like. Literally any device that can be attached to a strap is contemplated for use in the practice of the present invention.

As used herein, "retention loop 70" means a structure that surrounds or is attached to the strap 20 and which operates to hold one end 40 of the strap 20 in close proximity to the other end 60 of the strap 20, when the strap 20 has been secured by the securing mechanism 50. Again, referring to a watch band 20 as an example, retention loops 70 can be adjusted, typically by sliding them along the strap 20, in order to accommodate a range of lengths of excess strap material 110. Unfortunately, the adjustable nature of retention loops 70 prevents them from securely retaining the excess strap material 110. For example, if the loop 70 slides off of the end of the excess strap material 110, the excess 110 hangs free. A similar state results if the loop 70 slides in the direction of the securing mechanism 50 (e.g., buckle) to such an extent that the excess strap material 110 extends past the retention loop 70 far enough to again hang free. Thus, the present invention provides for both the strap 20 and the retention loop 70 to have a component of a mating structure 90,100 for securing the retention loop 70 to the excess strap material 110, thereby preventing the loop 70 from sliding off of the strap 20.

As used herein, "mating structures 90,100" means any structure that will provide for the temporary attachment of excess strap material 110 to the retention loop 70. Accordingly, the structure 90,100 will have a first component 90 and a complementary component 100 that mates with the first component 90. The relative location of the first and complementary components 90,100 is not important. Thus, either of the components 90,100 can be located on the strap 20, with the other component 90,100 being located on the loop 70.

In one embodiment of the present invention, the mating structure 90,100 comprises a protruding member 100 and a slot 90 or recessed area for receiving the protruding member. The mating of the member-slot structure 90,100 can merely comprise fitting the member 100 into the slot 90, or it can comprise a more positive lock. Positive locking between the member 100 and the slot 90 can be accomplished by providing for a snug fit of the member 100 into the slot 90 or the inclusion of a catch, such as additional mating structure inside or in the proximity of the slot 90, and corresponding additional mating structure on or in the proximity of the member 100, or the like, wherein the catch is engaged by the application of pressure, or the like. Other types of mating structures can clearly be employed in the practice of the present invention, and are contemplated as within the scope of the present invention. Examples of such mating structures include hook and loop fasteners, and the like. Additional examples of structures which can be employed as the retention component of the mating structures include those depicted in FIGS. 1–8, and the like While the invention has been described in detail with reference to certain preferred embodiments thereof, it will be understood that modifications and variations are within the spirit and scope of that which described and claimed.

What is claimed is:

1. A fastening and retention system for a strap, said system comprising:

a) a strap having at a first strap end, a securing mechanism configured to receive a second strap end, and b) one or more retention loops for maintaining, when said second strap end has been secured by said securing mechanism, said second strap end in close contact with a portion of the strap that is proximal to the first strap end, wherein said retention loop(s) can slide along said strap when the strap is not secured by said securing mechanism, wherein one or more of said retention loops comprises a first component of a mating structure, and said strap comprises a complementary component of the mating structure, wherein said complementary component of said mating structure comprises a protruding member and said first component of said mating structure comprises an aperture for receiving said protruding member, wherein said protruding member is located on said strap, and said aperture for receiving said protruding member is located on said retention loop, and wherein said mating structure prevents said loop(s) from sliding freely along said strap when the two components are mated.

2. A system according to claim 1, wherein said strap is a two piece strap comprising:

a) a first piece having a first device end and said first strap end, and b) a second piece having a second device end and said second strap end, wherein said first and second device ends comprise an attachment structure for securing said first and second pieces to a device.

3. A system according to claim 1, wherein said strap comprises one of the following materials: leather, rubber and a polymer.

4. A system according to claim 3, wherein said polymer is selected from the following list:

polyurethane, polyurethane/silicon blend, nylon, and polyvinyl chloride.

5. A system according to claim 1, wherein said strap is configured to receive thereon a device.

6. A system according to claim 5, wherein said device comprises at least one of the following: a wristwatch, an altimeter, a depth meter, a pedometer, a pager, a telephone a personal data device and a tide meter.

7. A system according to claim 6, wherein said device comprises a wristwatch.

8. A system according to claim 6, wherein said device comprises an altimeter.

9. A system according to claim 6, wherein said device comprises a depth meter.

10. A system according to claim 6, wherein said device comprises a pedometer.

11. A fastening and retention system, comprising:

a wrist-born device, a strap having a first end and a second end, the first end including a securing mechanism configured to receive a second end, and the strap being physically connected to the wrist-born device, and a retention loop for maintaining at least a portion of the second end in contact with at least a portion of the first end, wherein the retention loop comprises a first component of a mating structure, and the strap comprises a complementary component of the mating structure, the complementary component of the mating structure comprising a protruding member and the first component of the mating structure comprising an aperture for receiving the protruding member, and wherein the retention loop can freely slide along the strap when the strap is not secured by the securing mechanism, wherein the mating structure prevents the retention loop from sliding freely along the strap when the two components are mated.

12. A system comprising:

a retention loop defining an opening, a first strap passing through the opening, and a second strap passing through the opening, wherein the retention loop comprises a first component of a mating structure, and the second strap comprises a complementary component of the mating structure, the complementary component of the mating structure comprising a protruding member and the first component of the mating structure comprising an aperture for receiving the protruding member, and wherein the mating structure prevents the loop from sliding freely along the straps when the two components are mated.

* * * * *